United States Patent [19]

Crabtree et al.

[11] 3,988,855

[45] Nov. 2, 1976

[54] POSABLE FIGURE HAVING ONE PIECE CONNECTOR FOR TORSO, TRUNK AND LEGS

[75] Inventors: Alfred A. Crabtree, San Ramon, Calif.; Brian S. Prodger, Barrington; Hubert P. O'Connor, Warwick, both of R.I.

[73] Assignee: Hasbro Development Corporation, Pawtucket, R.I.

[22] Filed: May 1, 1975

[21] Appl. No.: 573,803

[52] U.S. Cl. ..... 46/161

[51] Int. Cl.[2] ..... A63H 3/20

[58] Field of Search ..... 46/151, 162, 115, 163, 46/173, 161

[56] References Cited

UNITED STATES PATENTS

| | | | |
|---|---|---|---|
| 1,940,608 | 12/1933 | Schavoir | 46/161 |
| 2,118,677 | 5/1938 | Lower | 46/161 |
| 3,010,253 | 11/1961 | Ostrander | 46/161 |
| 3,277,602 | 10/1966 | Speers et al. | 46/161 |
| 3,589,061 | 6/1971 | Bear et al. | 46/161 |
| 3,716,942 | 2/1973 | Garcia et al. | 46/163 |

*Primary Examiner*—F. Barry Shay

*Attorney, Agent, or Firm*—Salter & Michaelson

[57] ABSTRACT

A toy figure or doll having movable joints that simulate the comparable movable parts of the human anatomy. A stretchable inner connector extends into the legs of the toy figure and is interconnected to a trunk portion and torso in such a manner that in the assembled position of the toy figure, the torso and legs thereof are movable relative to each other and to the trunk portion to various posed positions.

16 Claims, 13 Drawing Figures

POSABLE FIGURE HAVING ONE PIECE CONNECTOR FOR TORSO, TRUNK AND LEGS

BACKGROUND OF THE INVENTION

The present invention relates to a toy figure such as a toy doll and has particular application in that kind of toy doll wherein the limbs thereof are articulated for location in a required posed position.

Toy figures and particularly toy dolls known heretofore have been constructed in various forms and of different kinds of materials depending upon the required use thereof. Many of the toy dolls known heretofore have been provided with movable joints that attempted to simulate the movable limbs of the human anatomy, and one example of such toy figure is illustrated in U.S. Pat No. 3,277,602. In many of the toy figures known heretofore, the simulated limbs thereof were interconnected by some form of a resilient or elastic member that enabled the limbs to be tensioned for movement to various posed position. Although these prior known toy figures having movable joints, as exemplified in U.S. Pat No. 3,277,602, performed the basic function required, the assembly of such toy figures was somewhat laborious and required more or less the precise fitting of the parts of the toy figure. Further, many of the toy figures as known in the prior art devices required various kinds of interconnecting pieces that were difficult to assemble and thereby increased the cost of manufacture of the toy figure.

With the advent of the miniature recording or talking device, such devices have been incorporated in toys to increase the play value thereof. It is desirable to include such a device in a toy figure that incorporates movable limbs thereon; but, in the prior known toy figures having articulated limbs, wherein each of the limbs could be moved to a posed position, the torso of the doll was obstructed by the various connecting parts for the limbs; and therefore the use of a talking device in a toy figure having articulated limbs has not been practical heretofore.

SUMMARY OF THE INVENTION

One of the unique features of the invention as embodied herein is the use of a connector member that interconnects the upper torso of the toy figure to the trunk and the leg members thereof. The connector member is preferably formed of a stretchable material and is interconnected to the torso, trunk and legs in tensioned relation but is restricted from extending into the major portion of the torso, which is substantially unobstructed. In order to assemble the connector to the torso, trunk portion and legs in tensioned relation, an upper portion thereof is pinned to the bottommost end of the torso that is received in the trunk portion. Elongated stretchable portions of the connector member are provided for assembly of the toy figure and extend through the legs and are interconnected to articulated knee and ankle joints. By locating the connector member under tension, the legs and the torso can be articulated to various posed positions, thereby simulating various positions of the human body.

Accordingly, it is an object of the invention to provide a toy figure having movable joints that closely simulate the corresponding movable portions of the human anatomy.

A further object of the invention is to provide a flexible connector that facilitates the assembly of the torso, trunk portion and legs of a toy figure so as to retain these members in interconnected relation relative to each other, wherein articulated parts of the legs and the torso are movable to posed positions as required.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figures 1, 2, 3, 3A, 4, 5, 6, 7, 8, 9, 10, 11, 12:
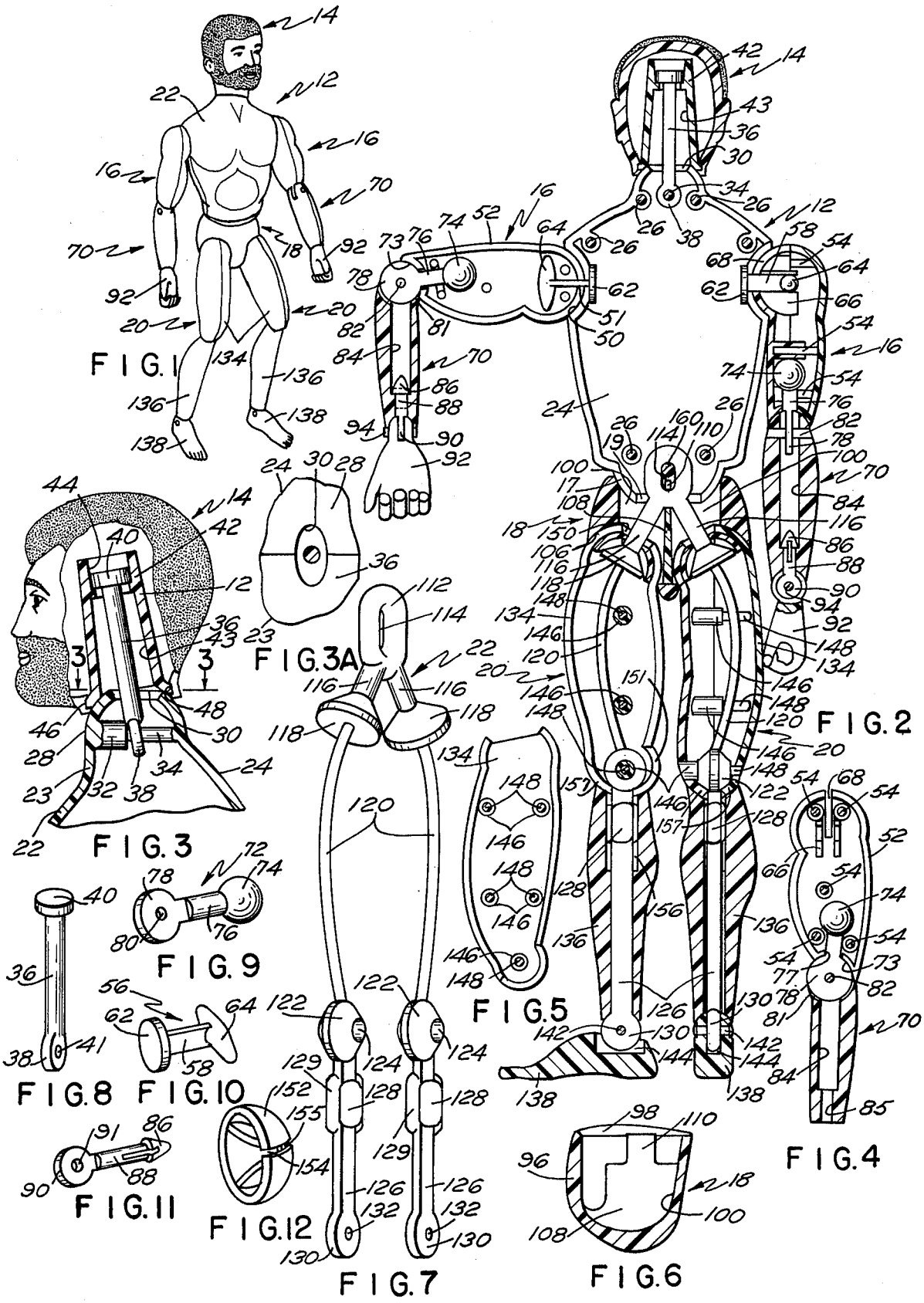
FIG. 1 is a perspective view of the toy figure as embodied in the present invention.
FIG. 2 is a vertical sectional view of the toy figure, showing one of the arms in a posed position.
FIG. 3, is an enlarged elevational view of the head and neck portion of the toy figure with parts cut away and shown in section.
FIG. 3*a* is a sectional view taken along line 3*a*—3*a* in FIG. 3.
FIG. 4 is an elevational view of one-half of a shell that defines an arm of the toy figure.
FIG. 5 is an elevational view of one-half of a shell that defines a thigh or upper member of a leg of the toy figure.
FIG. 6 is a sectional view of the trunk portion of the toy figure.
FIG. 7 is a perspective view of a one-piece stretchable connector that interconnects the torso, trunk portion and leg members of the toy figure.
FIG. 8 is a perspective view of a head pin by which the head portion is joined to the torso of the toy figure.
FIG. 9 is a perspective view of an elbow joint that interconnects the upper and lower parts of an arm of the toy figure.
FIG. 10 is a perspective view of an arm connector that pivotally mounts an arm on the torso of the toy figure.
FIG. 11 is a perspective view of a wrist pin that pivotally connects a hand to the lower arm portion of the toy figure.
FIG. 12 is a perspective view of a ball joint shell that is mounted in the upper portion of a leg and through which the one-piece connector extends for interconnecting the legs to the trunk portion in articulated relation.

Referring now to the drawing and particularly to FIGS. 1 and 2, the toy figure or doll embodied in the present invention is illustrated and is generally indicated at 10. The toy figure 10 includes a shell-like torso generally indicated at 12 on which a head member 14 is mounted. Mounted on the sides of the torso 12 adjacent to the upper end thereof are arms generally indicated at 16, while the lower end of the torso 12 is reduced as indicated at 17 and extends into a trunk portion generally indicated at 18, the reduced lower end of the torso having an opening 19 formed therein. Legs generally indicated at 20 are interconnected to the trunk portion 18, and a one-piece connector generally indicated at 22 is fixed to the reduced lower end 17 of the torso 12 and extends through the trunk portion 18 and into the legs 20 for the interconnection thereof, as will be described hereinafter. All of the various components that define the individual members of the toy FIG. 10 as illustrated in the drawing are preferably formed of nonmetallic materials such as various kinds of plastic or rubber.

The torso 12 which forms the body of the toy FIG. 10 is defined by a front shell portion 23 and a rear shell portion 24 that are provided with appropriately located pin and socket connections 26 that interfit for securing the front and rear shell portions 23 and 24 together. As will be described, and as more clearly illustrated in FIG. 2, the major portion of the interior of the torso 12 is substantially unobstructed, which provides for the insertion of a talking unit therein, if it is so desired. Preferably, the shells 23 and 24 are formed of a high impact styrene material and are molded in a manner to simulate the human male anatomy.

Referring to FIGS. 2, 3 and 3*a*, the uppermost end of the torso 12 is shown terminating in a reduced neck section 28 in which an elliptically shaped neck opening 30 is formed at the topmost end thereof. Joined to the front shell portion 23 of the torso 12 is a horizontally projecting socket portion 32, while joined to the rear shell portion 24 and extending into the socket portion 32 is a neck pin 34. A head pin 36 having an enlarged circular portion 38 formed on the lower end thereof extends through the neck opening 30 and has a disc-like portion 40 formed on the uppermost end thereof. The circular portion 38 has an opening 41 formed therein that receives the neck pin 34 therein when the neck pin 34 is inserted into the socket portion 32 upon securement of the front and rear shells 23 and 24 of the torso together. Mounted on the head pin 36 is a tapered head cone 42 that is formed with an interior bore 43 that communicates with an upper reduced bore 44 that receives the disc 40 of the head pin 36 in frictional contact therein. Since head pin 36 is prevented from outer movement by engagement of the circular portion 38 with the neck pin 34, the head cone 42 is fixed in position against outward movement, although sidewise and lengthwise movement thereof is provided with the head pin 36 within the neck opening 30. Formed on the lowermost end of the cone 40 is an outwardly extending flange 46 that is receivable in an annular groove 48 formed interiorly of the neck of the head 14. It is seen that the head 14, which is formed in a hollow configuration of the polyurethane material is readily deformable and is mounted in place on the head cone 40 by snapping the annular groove 48 over the flange 46 of the head cone 40. Since the head 14 is movable with the head cone 40 and head pin 36, movement of the head 14 is provided relative to the torso 12, the neck opening 30 permitting both lengthwise and sidewise movement of the head 14.

Formed in both sides of the torso 12 adjacent to the uppermost end thereof are opposed concave depressions 50 that define arm sockets for receiving the upper ends of the arms 16. As will be described each arm socket 50 has an opening 51 formed therein through which an arm connector extends. As shown in FIGS. 2 and 4, each of the arms 16 includes an upper arm member 52 that is defined by opposed shells, one of which is illustrated in FIG. 4 and that are interfitted together by pins 54 integrally molded to the interior of one of the upper arm shells and located in appropriate position therein. It is understood that the pins 54 extend into sockets formed in corresponding positions in the other upper arm shell and are fixed therein for joining the shells to define the upper arm members 52. In order to mount an upper arm member 52 in an arm socket 50 for pivotal movement therein, an upper arm connector generally indicated at 56 is provided, and as illustrated in FIG. 10, the upper arm connector 56 includes a bar 58 that projects through the opening 51 in the arm socket 50 of an upper arm member 52 and is received on the inner side of the socket 50 as illustrated in FIG. 2. A disc 62 is joined to the bar 58 and is located interiorly of the torso 12 in frictional engagement with the inner surface of the arm socket 50, while a cross bar 64 that is also joined to the bar 58 is mounted in appropriate grooves in brackets 66 (FIG. 4) formed in one of the shells of the upper arm member 52. Also formed in one of the shells of the upper arm member 52 on the inner side thereof and adjacent to the socket 50 is a slot 68 (FIG. 4) through which the bar 58 extends. Thus, the upper arm member 52 of each arm is pivotally movable in a manner as illustrated in FIG. 2 from a lower substantially vertical position to an upper horizontal position. The arms 16 also have movement from front to rear as permitted by rotation of the upper arm connectors 56 within the arm sockets.

Referring again to FIGS. 2 and 4, the outermost end of the upper arm member 52 is shown being formed with a concave socket 73 in which a spherical portion 74 of the elbow connector 72 is received. The elbow connector 72 also includes a connecting bar 76 that is joined to the spherical portion 74 and to which a circular portion 78 is joined at the other side thereof, the circular portion 78 having an opening 80 formed therein. The connecting bar 76 of the elbow connector 72 extends through an opening 77 formed in the socket 73 and is received between a pair of pins 54 and their sockets that join the shells of the upper arm member 52 together, the spherical portion 74 located and dimensioned such that it provides for capturing of the elbow connector 72 within the upper arm member 52. The circular portion 78 is received in a socket 81 located in the uppermost end of the lower arm member 70 and is secured thereto by a pin 82 that extends through the opening 80 in the circular portion 78 and through the adjacent sections of the lower arm portion 70. A bore 84 extends longitudinally through the lower arm member 70 and communicates with a reduced passage 85 (FIG. 4). A wrist pin 88 extends through the passage 85 and includes a head 88 that is received in the bore 84 to lock the wrist pin to the lower end of the lower arm member 70. A circular portion 90 in which an opening 91 is formed extends outwardly of the lowermost end of the lower arm member 70 and is secured to a hand 92 by a pin 94, the uppermost end of the hand 92 through which the pin 94 extends being reduced for being received in a socket portion formed in the outermost end of the lower arm member 70. It is seen that the hand 92 as mounted on the lower arm portion 70 has pivotal movement relative thereto.

The trunk portion 18 provides an intermediate connection between the torso 12 and the legs 20 and is shaped and proportioned for accommodating these members in articulated relation. Referring to FIGS. 2 and 6, the trunk portion 18 is shown including a main body portion 96 that is essentially hollow in construction as defined by an upper opening 98 that communicates with a tapered interior bore 100. The opening 98 is dimensioned for receiving the reduced tapered end 17 of the torso therein, the opening 19 in the reduced end of the torso being located within the bore 100 in the assembled position of the torso and trunk portion. Spaced openings 106 are formed in the lowermost end of the trunk portion 18 and accommodate the uppermost ends of the legs 20, the axes of the openings in the sockets 106 being generally inclined with respect to the vertical. Fixed interiorly of the trunk portion 18 and bisecting the bore 100 between the leg sockets 106 is a rib 108 that terminates at the uppermost end thereof in an upstanding portion 110, the upstanding portion 110 receiving the uppermost end of the connecting member 22 thereon, as will be described.

The connector 22, illustrated in FIG. 7, provides for the assembly of the legs 20 thereon, and also positively interconnects the torso 12, trunk portion 18, and legs 20 so that the legs and torso may be moved into various posed positions. As shown in FIG. 7, the connector 22 is formed in a one-piece construction and is preferably molded of a rubber or rubberized material so as to have stretching characteristics. The uppermost portion of the connector 22 is defined by a torus-like ring 112 having a generally oval configuration and formed with an opening 114 therein. Joined to the ring 112 with substantially the same cross-sectional dimension thereof and projecting downwardly in angular relation thereto are leg pieces 116. Cone elements 118 are joined to the leg pieces 116, and as will be described provide for connection of the legs 20 to the connector 2 and trunk portion 18. Joined coaxially to the cone portions 118 and depending therefrom are elongated flexible portions 120 that are reduced in cross-sectional configuration. Joined to the lowermost ends of the elongated portions 120 are knee joints 122 that are defined by back-to-back frustro-conical portions through the central axes of which openings 124 extend. Downwardly depending bar portions 126 are joined to the knee joints 122, protuberances 128 and 129 being formed as an integral part of the bars 126 intermediate the ends thereof. Joined to the lowermost ends of the bar portions 126 are enlarged circular portions 130 through which openings 132 extend.

Each of the legs 20 is defined by an upper leg member 134 to which a lower leg member 136 is connected in articulated relation. A foot 138 is pivotally interconnected to the lower leg member 136 by a pin 142 that extends through the enlarged circular portion 130. In order to accommodate the circular portion 130 within the foot 138, a recess 144 is formed in the upper end of the foot, as more clearly illustrated in FIG. 2. The upper leg member 134 of each leg member 20 is defined by mating half shells, one of which is illustrated in FIG. 5. One of the half shells is formed with a plurality of socket members 146 located in appropriate positions thereon that receive pins 148 that are joined to the other half shell, the socket members 146 and pins 148 cooperating to interlock the half shells in place. The lowermost end of each upper leg member 134 is formed with a slot 151 that receives the bar portion 126 of a lower leg member therein. In this connection the rearward extent of the slot 151 is greater than the forward portion thereof, which enables the lower leg member 136 to pivotally move to a right angle position relative to the upper leg member 134. The uppermost end of the upper leg member 134 is rounded for snugly interfitting in the socket opening 106 of the trunk portion 18, an opening 150 also being formed in the uppermost portion of the upper leg member 134 through which a leg piece 116 of the connecting member 22 extends. The cone portions 118 are received within the rounded upper portions of the upper leg members 134, and in order to frictionally locate the upper leg members 134 in the socket openings 104, for movement to and from posed positions, upper leg ball joints 152 are provided. As seen in FIG. 12, each upper leg ball joint 152 is formed in a semishell configuration and has a slit 154 formed in the wall thereof that communicates with a hole 155 located at the upper end. The slit 154 enables the ball joint 152 to be snapped over a leg piece 116 into surrounding relation relative to a cone portion 118, the leg piece 116 extending through the hole 155 in the assembled position thereof. The shell configuration of each ball joint 152 corresponds to that of the socket opening 106, wherein each ball joint 152 is snugly received in a socket opening 106 to provide for frictional movement of the uppermost portion of the leg 20 relative to the trunk portion 18.

The elongated portions 120 of the connector 22 extend through the shell-like upper leg members 134 and terminate at the lower ends of the upper leg members 134 in the knee joints 122. The knee joints 122 are locked to the lowermost end of the upper leg members 134 by a pin 148 that is received in a socket 146, the pins 148 extending through the openings 124 of the knee joints 122.

In the assembly of the connector 22 to the torso 12, trunk portion 18 and legs 20 the connector 22 are fixed in place in the upper leg member 134 and lower leg member 136 as illustrated. The lower bars 126 of the connector 22 are frictionally locked within bores 156 as formed in the upper ends of the lower leg members 136, the enlarged or projecting portions 128 and 129 engaging surfaces of the bores 156 as illustrated in FIG. 2. The bars 126 of the connector 22 extend downwardly through reduced bores 158 of the lower leg member 136 beyond the lowermost ends thereof for attachment of the foot members 138 to the circular portion 130 thereof. The uppermost ends of the lower leg members 136 provided with sockets having opposed flat portions 157 that receive the rounded lower end of the upper leg member 134, thereby providing for selfaligning of the lower end of the upper leg member relative to the socket opening in the upper end of the lower leg member 136. The self-alignment of the rounded lower end of each upper leg member in a socket opening of a lower leg member insures proper orientation of the upper leg member relative to the lower leg member, wherein the slot 151 is properly located for receiving the upper end of the bar portion 126 therein. As described, the leg members 134 and 136 are assembled on the connector 22, the knee joints 122 being fixed in place by pins 148 that project therethrough, and the ball joints 152 being mounted on the cone portions 118 that are fitted within the interior of the uppermost ends of the leg members 134. The legs 20 and torso 24 are then interconnected to the trunk portion 18 in tensioned relation by lifting the ring 112 of the connector 22 upwardly for location of the underside thereof on the upstanding portion 110 of the rib 108. This is accomplished by stretching the connector 22, the component parts thereof being tensioned within the trunk portion 18 and legs 20 when the underside of the ring 112 is disposed on the rib 108 between the angular leg pieces 116 that are located interiorly of the trunk portion 18. Since mounting the ring 112 of the connector 22 on the rib 108 draws the cone portions 118 and ball joints 152 into friction fitting relation in the sockets 106 the legs are located in tensioned relation in the leg sockets, and the torso 12 is moved into tensioned position relative to the trunk 18. The ring member 112 is retained on the rib 108 by a pin 160 that projects through suitable openings as formed in the reduced end 17 of the torso 12, the rubberized connector 22 thus interconnecting the torso 12, trunk portion 18 and legs 20, including the feet 138, in tensioned relation. It is seen that the lowermost end 17 of the torso 12 that is seated in the trunk portion 18 may be moved to various posed positions because of the tensioned relation relative thereto. The upper members 134 of the legs 20 which are seated in the socket openings 106 of the trunk portion 18 may also be pivotally moved to various posed positions because of the tensioned interconnection thereof as provided for by the upper portion of the connector member 22. The lower leg members 136 are similarly pivotally movable relative to the upper leg members 134 through the knee joints 122 and the feet 138 are pivotally movable relative to the lower leg members 136.

In connection with movement of the feet 138, it is contemplated to form a detent or enlargement on the spherical area of the upper side of each foot 138 to allow limited rotation of the foot 138 relative to the lower leg member 136. This will insure that each foot 138 will always remain in contact with a horizontal surface on which the toy figure is placed for locating the toy figure in a standing position.

It is further seen that the use of the connecting member 22 in the manner as described eliminates the tendency of the legs 20 and the torso 12 to return to a neutral position after being moved to a desired posed position. This is accomplished since the connector 22 is secured within the true center of the reduced portion 17 of the torso. Further, the use of the connector 22 facilitates assembly of the leg components. Thus the upper and lower leg portions are easily assembled in position by mounting them on the elongated portions 120 and the bar portions 126. Once the leg portions are pinned in place, the elongated portions 120, for example, no longer have a supportive function. In this connection it is also contemplated that the connector 22 be formed without the elongated portions 120, and in this instance the ring member 112, leg pieces 116 and cone elements 118 would define the one-piece connector construction with the knee joints 122 and bars 126 being formed separately from the connector.

The ball joints 152 which are formed of a polyethylene material provide a smooth surface on which the upper portion of the upper leg member 134 can move as it is rotated relative to the trunk portion 18. Since the ball joints 152 provide a friction surface for the upper portions of the leg members 134, the leg members can be moved to various posed positions as desired. The flats 157 in each socket of a lower leg member orient the location of the rounded lower end of the upper leg member 134, whereby the knee joints 122 permit the approximately 90° rearward movement of each lower leg members 136 relative to the upper leg members 134. Movement of either leg relative to the torso 12 is accomplished by rotating an upper leg member 134 relative to the trunk portion 18 as permitted by the interconnection thereof through a ball joint 152. Thus, the legs are constrained to be located in a posed position thereof because of the tension created thereon through the interconnection of the upper portions of each leg member to the trunk portion 18 by the cone elements 118.

All of the parts of the toy FIG: 10 are fabricated of various kinds of plastic materials, depending upon the use thereof; and it is seen that the parts may be formed relatively inexpensively and are capable of being assembled with a minimum of effort, particularly in view of the connector 22 that provides for mounting of the leg members 20 thereon in articulated relation relative to the trunk portion 18. Further, since the interior of the torso 12 is relatively unobstructed, a talking unit or similar device may be inserted therein if it is so desired.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy figure, comprising a torso formed in a hollow shell construction, a head member mounted on the uppermost end of said torso for movement relative thereto, arms interconnected to said torso on opposite sides thereof and adjacent to the upper end thereof for movement relative thereto, said arms and head being unconnected with each other within said torso, a trunk portion received the lowermost end of said torso in interfitting relation therein, a pair of legs interconnected to said trunk portion and to the lowermost end of said torso, and a flexible one-piece connector having an upper portion that is located substantially in said trunk portion and that is interconnected to said trunk and legs and to only the lowermost portion of said torso so as to provide tensioned interengagement between said trunk, legs and torso and to further provide that substantially the entire interior of said torso is free and unobstructed from connecting members.

2. A toy figure as claimed in claim 1, said flexible one-piece connector being resiliently stretchable for being placed under tension when interconnected to said torso, trunk portion and legs.

3. A toy figure, comprising a torso formed in a hollow shell construction, a head member mounted on the uppermost end of said torso for movement relative thereto, arms interconnected to said torso on opposite sides thereof and adjacent to the upper end thereof, a trunk portion receiving the lowermost end of said torso in interfitting relation therein, a pair of legs interconnected to said trunk portion and to the lowermost end of said torso, and a flexible one-piece connector interconnected to said torso, trunk and legs so as to provide tensioned interengagement therebetween, said flexible one-piece connector being resiliently stretchable for being placed under tension when interconnected to said torso, trunk portion and legs said one-piece connector including an upper portion that is interconnected to said torso and that is mounted under tension on said trunk portion, conical portions interconnected to said upper connector portion and being receivable in leg socket openings formed in said trunk, each of said legs including an upper leg member, the uppermost end of which is receivable in a leg socket opening in surrounding relation relative to a conical portion, and a lower leg member that depends below said upper leg member.

4. A toy figure as claimed in claim 3, a ball joint shell located on said connector in surrounding relation around each of said conical portions and being receivable in a leg socket opening in said trunk portion for frictionally mounting said legs on said trunk portion for movement relative thereto, wherein the legs are selectively movable to a predetermined posed position and are returnable only upon an external force being applied thereto.

5. A toy figure as claimed in claim 4, said one-piece connector further including enlarged knee joints and lower leg portions joined to said knee joints and depending therefrom, a transverse opening formed in each of said knee joints, a transverse opening formed in the lower end of the upper leg member of each leg and being aligned with an opening formed in a knee joint, and a pin extending through the aligned transverse openings for pivotally mounting the lower leg member of each leg on the upper leg member thereof.

6. A toy figure, comprising a torso formed in a hollow shell construction, a head member mounted on the uppermost end of said torso for movement relative thereto, arms interconnected to said torso on opposite sides thereof and adjacent to the upper end thereof, a trunk portion receiving the lowermost end of said torso in interfitting relation therein, a pair of legs interconnected to said trunk portion and to the lowermost end of said torso, and a flexible one-piece connector interconnected to said torso, trunk and legs so as to provide tensioned interengagement therebetween, said one-piece connector being formed of a rubber-like material and including an upper portion mounted in said trunk portion, flexible and stretchable elongated portions interconnected to said upper portion and extending interiorly through upper members of said legs, and bar-like portions interconnected to said flexible and stretchable elongated portions and depending therefrom and extending interiorly of lower leg members of said legs.

7. A toy figure as claimed in claim 6, said torso being formed by mating half-shell portions, means for interconnecting said half-shell portions, said interconnecting means including a transversely extending pin located adjacent to the lower end of said torso and projecting through said upper portion of said one-piece connector to mount said torso in said trunk portion in tensioned relation.

8. A toy figures as claimed in claim 6, said torso having an opening formed in the uppermost end thereof, a head pin secured to said torso and extending upwardly through said opening for projection therebeyond, a head mounting cone secured to said head pin and having an annular flange formed on the lower end thereof, said head member including a neck portion on the inside of which an annular groove is formed that receives said annular flange therein when said head member is mounted on said mounting cone to fix said head member thereon in rotatable relation.

9. A toy figure as claimed in claim 8, the opening in the uppermost end of said torso being substantially elliptical in configuration, the greatest dimension of which extends front to rear, wherein movement of said head member as mounted on said mounting cone and head pin is greatest in the forwardly and rearwardly directions.

10. A toy figure as claimed in claim 7, circular depressions being formed in said torso at the sides thereof and adjacent the upper end to define arm sockets, each of said arms including a hollow upper arm member having a rounded upper end that is received in an arm socket, and an upper arm connector fixed in each upper arm member and projecting through an adjacent arm socket for securement within said torso to pivotally mount said arms on said torso.

11. A toy figure as claimed in claim 10, said upper arm connector being formed in a one-piece construction and including a enlarged disc portion that is located within said torso, a connecting bar joined to said disc portion and extending outwardly of said torso through an opening formed in the adjacent arm socket, and a cross bar joined to said connecting bar and fixed interiorly of the upper arm member of the arm.

12. A toy figure as claimed in claim 10, an elbow connector fixed to the lower end of each upper arm member and extending outwardly therefrom, and a lower arm member pivotally connected to the elbow connector of each arm to provide relative movement between the upper and lower arm members, and a hand pivotally connected to the lower end of each lower arm member.

13. A toy figure, comprising a torso formed in a hollow shell construction, a head member mounted on the uppermost end of said torso for movement relative thereto, arms interconnected to said torso on opposite sides thereof and adjacent to the upper end thereof, a trunk portion receiving the lowermost end of said torso in interfitting relation therein, a pair of legs interconnected to said trunk portion and to the lowermost end of said torso, and a flexible one-piece connector interconnected to said torso, trunk and legs so as to provide tensioned interengagement therebetween, said trunk portion having an upper opening for receiving the lowermost end of said torso, and spaced lower openings, the axes of which are normally inclined to the vertical for receiving the uppermost portion of the upper members of said legs therein, and a bracket secured in said trunk portion between said openings and located in substantially a vertical plane, said one-piece connector being mounted on said bracket for tensioning said connector in the position of use.

14. A toy figure as claimed in claim 13, said one-piece connector including an upper portion that is mountable on said bracket, elongated flexible and stretchable portions interconnected to said upper portion and extending interiorly through upper members of said legs and lower bar-like portions interconnected to said elongated portions and depending therefrom and being received interiorly of lower members of said legs.

15. A toy figure as claimed in claim 14, angularly disposed rod-like leg pieces joined to said upper portions of said connector and extending through the angularly disposed openings in said trunk portion and into the upper portions of said upper leg members, a frusto-conical portion joined to said leg piece and simulating a ball-joint for the hip of said trunk, and a ball-joint shell mounted on each leg piece in surrounding relation with respect to a frusto-conical portion and being receivable in the angularly disposed openings in said trunk portion for frictionally mounting said legs in said trunk portion.

16. A toy figure as claimed in claim 14, each of said lower bar-like portions having a knee joint joined to the uppermost end thereof and an ankle joint joined to the lowermost end thereof, the upper members of each of said legs having a shell configuration through which said elongated and stretchable portions extend, the lowermost end of said elongated and stretchable portions receiving a knee joint therein in pivotal relation to provide for pivotal movement of the lower member of a leg relative thereto, and the lower member of each leg having a bore through which a bar-like portion extendsand the lowermost end of which receives an ankle joint therein to provide for pivotal movement of a foot interconnected thereto.

* * * * *